United States Patent [19]

Inoue et al.

[11] Patent Number: 4,458,703

[45] Date of Patent: Jul. 10, 1984

[54] SYSTEM FOR CLEANING ARTICLES

[75] Inventors: Yosuke Inoue, Ibaraki; Michiyoshi Maki, Hachioji; Masahiro Wanami, Hadano; Akira Kabashima, Ome, all of Japan

[73] Assignee: Hitachi, Ltd., Tokyo, Japan

[21] Appl. No.: 396,031

[22] Filed: Jul. 7, 1982

[30] Foreign Application Priority Data

Jul. 8, 1981 [JP] Japan ..... 56-105521

[51] Int. Cl.[3] ..... B08B 3/04

[52] U.S. Cl. ..... 134/57 R; 134/64 R; 134/109

[58] Field of Search ..... 134/57 R, 61, 64 R, 134/75, 109, 111; 68/181 R

[56] References Cited

U.S. PATENT DOCUMENTS

| | | | |
|---|---|---|---|
| 2,923,648 | 2/1960 | K'Burg | 134/111 X |
| 2,949,337 | 8/1960 | Oldershaw | 68/181 R X |
| 3,693,953 | 9/1972 | Michel | 134/75 X |
| 3,717,161 | 2/1973 | Fukai et al. | 134/64 R |
| 4,325,746 | 4/1982 | Popplewell et al. | 134/109 X |

*Primary Examiner*—Robert L. Bleutge

*Attorney, Agent, or Firm*—Antonelli, Terry & Wands

[57] ABSTRACT

Cleaning system to clean articles to remove foreign matters from surfaces of the articles. At least two treatment baths filled with respective cleaning liquids are provided. An intermediate bath is located between the adjacent two treatment baths. The intermediate bath is filled with the cleaning liquid filled in one of a pair of the adjacent treatment baths adjacent to the intermediate bath, and the cleaning liquid filled in the intermediate bath is then replaced with the cleaning liquid filled in the other treatment bath. At least one of the articles is moved successively from a first to the last one of the at least two treatment baths and through at least one the intermediate bath, while the article is maintained continuously and completely immersed in the cleaning liquid.

16 Claims, 6 Drawing Figures

SYSTEM FOR CLEANING ARTICLES

BACKGROUND OF THE INVENTION

1. Field of the Invention

The present invention relates to a method of and a system for cleaning articles to remove foreign matters, such as impurities, dust or the like from surfaces of the articles.

2. Description of the Prior Art

The technique disclosed in Japanese Patent Laying-Open No. 45575/72 laid open for public inspection on Dec. 25, 1972 is arranged such that a plurality of treatment baths receiving therein respective cleaning liquids are provided; a cartridge is provided for holding therein a plurality of articles to be cleaned; the cartridge having held therein the articles is immersed in a first of the cleaning liquids filled in a first of the treatment baths to clean the articles by the first cleaning liquid; after the articles are cleaned by the first cleaning liquid within the first treatment bath, the cartridge having held therein the articles is moved out of the first treatment bath through the free surface of the first cleaning liquid within the first treatment bath to expose the articles held in the cartridge to an environmental atmosphere; the cartridge having held therein the articles is then introduced from the environmental atmosphere into a second of the treatment baths through the free surface of a second of the cleaning liquids filled therein and immersed in the second cleaning liquid to clean the articles by the second cleaning liquid; after the articles are cleaned by the second cleaning liquid within the second treatment bath, the cartridge having held therein the articles is moved out of the second treatment bath through the free surface of the second cleaning liquid therewithin the expose the articles held in the cartridge to the environmental atmosphere; and so on.

A major portion of foreign matters removed from the surfaces of the articles by the cleaning operation within each treatment bath is floated on the free surface of the cleaning liquid within the treatment bath, and the remaining minor portion of the foreign matters is suspended in the cleaning liquid. It is of course that the foreign matters are suspended in the environmental atmosphere. When the articles to be cleaned are into contact with any solid body, the foreign matters deposited on the solid body are transferred to the articles.

As described previously, the technique disclosed in the Japanese patent laying-open publication is arranged such that the cartridge having held therein the articles to be cleaned is moved out of each treatment bath through the free surface of the cleaning liquid therewithin into the environmental atmosphere, after the cleaning of the articles by the cleaning liquid within the treatment bath, and is then moved from the environmental atmosphere into the adjacent treatment bath through the free surface of the cleaning liquid therewithin. This causes the foreign matters floated on the free surface of the cleaning liquid to be deposited on the articles, and also causes the foreign matters suspended in the environmental atmosphere to be deposited on the articles. Thus, the articles are again contaminated with the foreign matters after each cleaning operation, and it is difficult to expect to have a high cleaning efficiency.

SUMMARY OF THE INVENTION

An object of the present invention is to provide a method of and a system for cleaning articles with a high cleaning efficiency.

According to the present invention, there is provided a method of cleaning articles to remove foreign matters from surfaces of the articles, comprising the steps of: preparing at least two treatment baths and an intermediate bath located between the adjacent two treatment baths; filling a first of the at least two treatment baths with a first cleaning liquid; immersing at least one of the articles to be cleaned completely in the first cleaning liquid filled in the first treatment bath to clean the article for removing foreign matters from the surface thereof; filling the intermediate bath adjacent to the first treatment bath with the first cleaning liquid; moving the article from the first treatment bath filled with the first cleaning liquid to the intermediate bath filled with the first cleaning liquid, while maintaining the article completely immersed in the first cleaning liquid, to completely immerse the article in the first cleaning liquid within the intermediate bath; replacing the first cleaning liquid within the intermediate bath in which the article is immersed, with a second cleaning liquid, while maintaining the article continuously and completely immersed in at least one of the first and second cleaning liquids; filling a second of the at least two treatment baths adjacent to the first treatment bath with the second cleaning liquid; and moving the article from the intermediate bath filled with the second cleaning liquid to the second treatment bath filled with the second cleaning liquid, while maintaining the article completely immersed in the second cleaning liquid, to completely immerse the article in the second cleaning liquid within the second treatment bath to clean the article for removing foreign matters from the surface thereof.

According to the present invention, there is also provided a system for cleaning articles to remove foreign matters form surfaces of the articles, comprising: at least two treatment baths and an intermediate bath disposed between the adjacent two treatment baths, these baths being connected in series to each other, at least one of the articles to be cleaned being successively moved from a first to the last one of the treatment baths through at least one the intermediate bath; tanks with one associated with each of the treatment baths and receiving respective cleaning liquids; supply line means connecting each of the at least two treatment baths and the adjacent intermediate bath to the tank associated with the treatment bath; delivery means for forcedly delivering the cleaning liquid from each of the tanks to the associated treatment bath and the adjacent intermediate bath through the associated supply line means; when a first of the at least two treatment baths is filled with a first of the cleaning liquids supplied from a first of the tanks associated with the first treatment bath by a first of the delivery means associated with the first treatment bath, the article being completely immersed in the first cleaning liquid within the first treatment bath and cleaned by the first cleaning liquid so as to cause foreign matters to be removed from the surface of the article; moving means for moving the article between each of the at least two treatment baths and the adjacent intermeidate bath, the moving means moving the article from the first treatment bath filled with the first cleaning liquid to the intermediate bath filled with the first cleaning liquid supplied from the first tank through the first supply line means by the first delivery means, while maintaining the article completely immersed in the first cleaning liquid, the article being completely immersed in the first cleaning liquid within the intermediate bath; replacing means for replacing the first cleaning liquid within the intermediate bath with a second of the cleaning liquids supplied from a second of the tanks associated with a second of the at least two treatment baths adjacent to the first treatment bath through a second of the supply line means associated with the second treatment bath, after the article is moved from the first treatment bath filled with the first cleaning liquid to the intermediate bath filled with the first cleaning liquid; and after the first cleaning liquid within the intermediate bath is replaced with the second cleaning liquid, the moving means moving the article from the intermediate bath filled with the second cleaning liquid to the second treatment bath filled with the second cleaning liquid supplied from the second tank through the second supply line means by the second delivery means, while maintaining the article completely immersed in the second cleaning liquid, the article being completely immersed in the second cleaning liquid within the second treatment bath and being cleaned by the second cleaning liquid so as to cause foreign matters to be removed from the surface of the article.

DETAILED DESCRIPTION OF THE PREFERRED EMBODIMENTS

Figure 1:
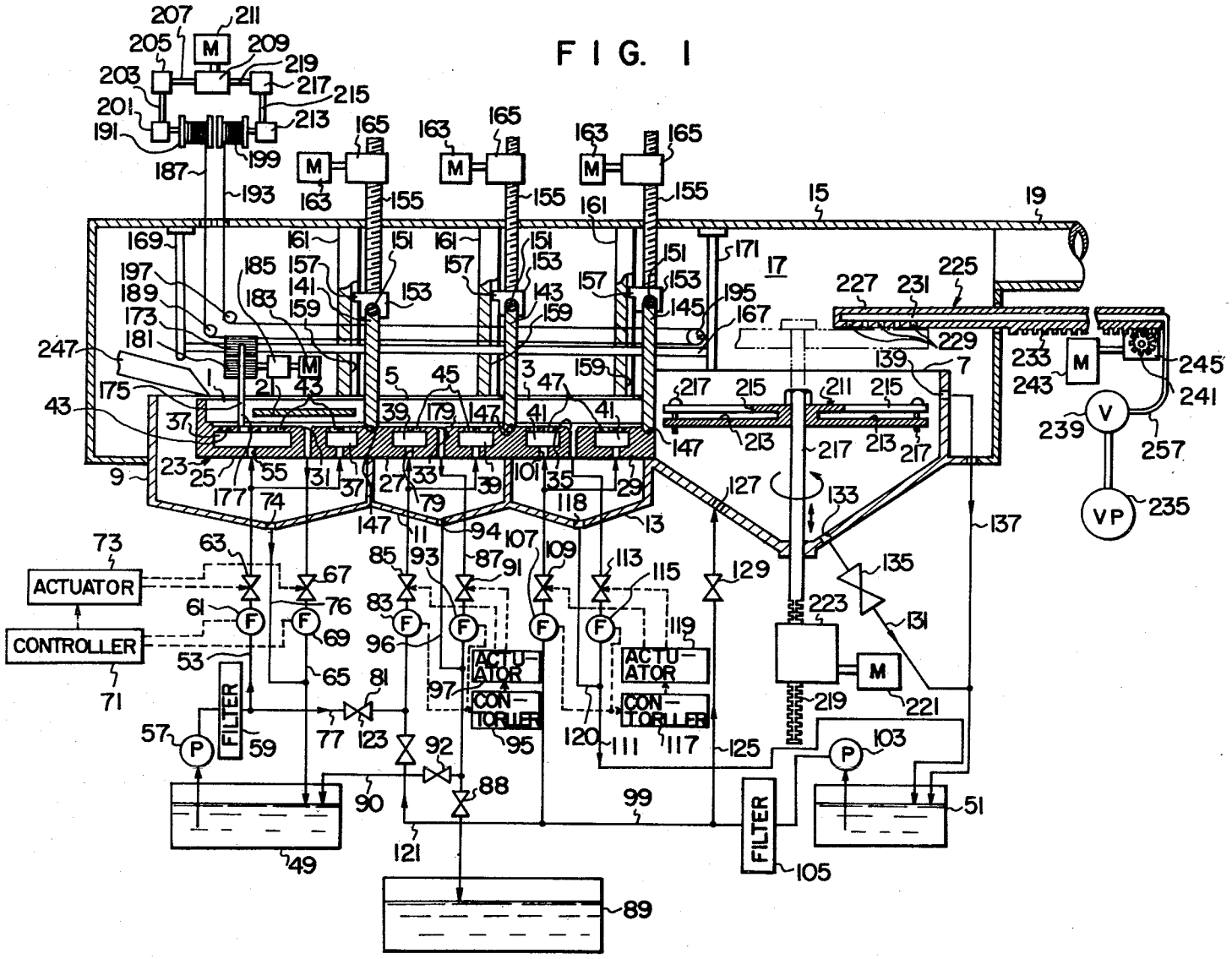
FIG. 1 is a schematic cross-sectional view showing an embodiment of an article cleaning system in accordance with the present invention.

Embodiments of the present invention which is applied to semiconductor wafers as articles to be cleaned will be described with reference to the accompanying drawings. It is to be understood, however, that the present invention is not limited to the cleaning of the semiconductor wafers, but is applicable to any articles required to be cleaned. More specifically, the present invention is particularly suitable for the cleaning of laminate articles, such as magnetic discs, liquid crystal discs, photomasks or the like in addition to the semiconductor wafers.

In the manufacture of semiconductor devices, the surface of the semiconductor wafer which is a component of the semiconductor device is subjected to various heat treatments. Typical heat treatments include an oxidized film forming process by thermal oxidization, impurity diffusion process, vapor phase process of an epitaxial growth layer or the like, and so on.

The semiconductor wafer subjected to such heat treatments is required to have a sufficient clean surface. The reason for this is that should foreign matters such as impurities, dust or the like be deposited on the wafer surface, these foreign matters would have an unnecessary reaction with the wafer material, or would be diffused into the wafer material during the heat treatments. If this occurs, crystal deffects may be introduced into the wafer material, the lifetime of the carriers within the wafer material may be decreased, and an abnormal diffusion may occur in the wafer material in the directions perpendicular and parallel to the main surface of the wafer.

In recent years, the semiconductor device is becoming highly precise and fine or minute more and more. For example, in the manufacture of IC, LSI or the like, various patterns for a semiconductor element drawn on the surface of the semiconductor wafer are approaching the order of 1 μm. Therefore, the foreign matters each having diameter on the order of 0.5–1 μm for example, influence considerably badly the characteristics of the semiconductor device. Such bad influence occurs not only in the above-mentioned heat treatments at high temperature, but also in low temperature treatments such as photolithography process and vacuum evaporation process of fine wiring films, for example.

The same trouble occurs in individual semiconductor devices having fine electrode structures, such as gate turn-off thyristors, electrostatic induction type thyristors or the like. The gate turn-off thyristor or the like is formed so as to have a multiplicity of divided sections such that cathode areas and cathode electrodes formed thereon are respectively surrounded by opposite induction type gate areas and gate electrodes formed thereon, in order to primarily improve the turn-off characteristics. Therefore, the pn junctions exposed to the same main surface area have their increased length, and even if the foreign matters are less in number, the probability that the foreign matters exist in the pn junctions is increased. The semiconductor device of the kind referred to above is used in such a manner that all of the cathode electrodes divided by external electrode plates are electrically connected to each other. Accordingly, should one of the pn junctions be made incomplete due to the foreign matters, the entire semiconductor device would be failed.

It will be understood from the foregoing that it is very important to sufficiently clean the semiconductor wafer to remove foreign matters from the surface of the wafer.

Referring now to FIG. 1, there is shown in schematic cross-section a cleaning system in accordance with the embodiment of the present invention. The cleaning system comprises at least two treatment baths 1, 3 and an intermediate bath 5 disposed between the adjacent two treatment baths 1 and 3. The cleaning system is illustrated as comprising a drying bath 7 disposed adjacent to the last treatment bath. Overflow baths 9, 11 and 13 are respectively associated with the baths 1, 5 and 3 for receiving and collecting cleaning liquids overflowed from the baths 1, 5 and 3, respectively. An enclosure 15 cooperates with the wall of the overflow baths 9, 11 and 13 and the wall of the drying bath 7 to define an environmental space 17 of Class 1000 in which foreign matters each having a diameter greater than 1 μm are suspended 1000 per unit cubic foot. The space 17 is filled with air or inert gas such as nitrogen. A duct 19 connected to the enclosure 15 conducts gases generated during the cleaning treatment of the semiconductor wafer 21 within the treatment baths 1 and 3 into a space outside of the space 17.

Figure 2:
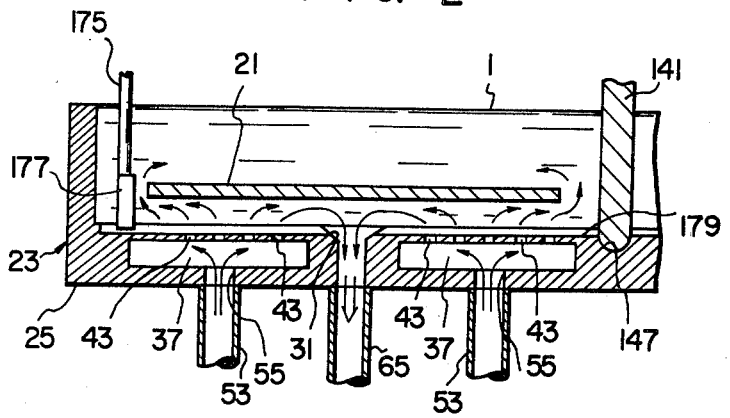
FIG. 2 is a schematic cross-sectional view showing an article to be cleaned suspended in a cleaning liquid filled in a treatment bath.
Figure 3:
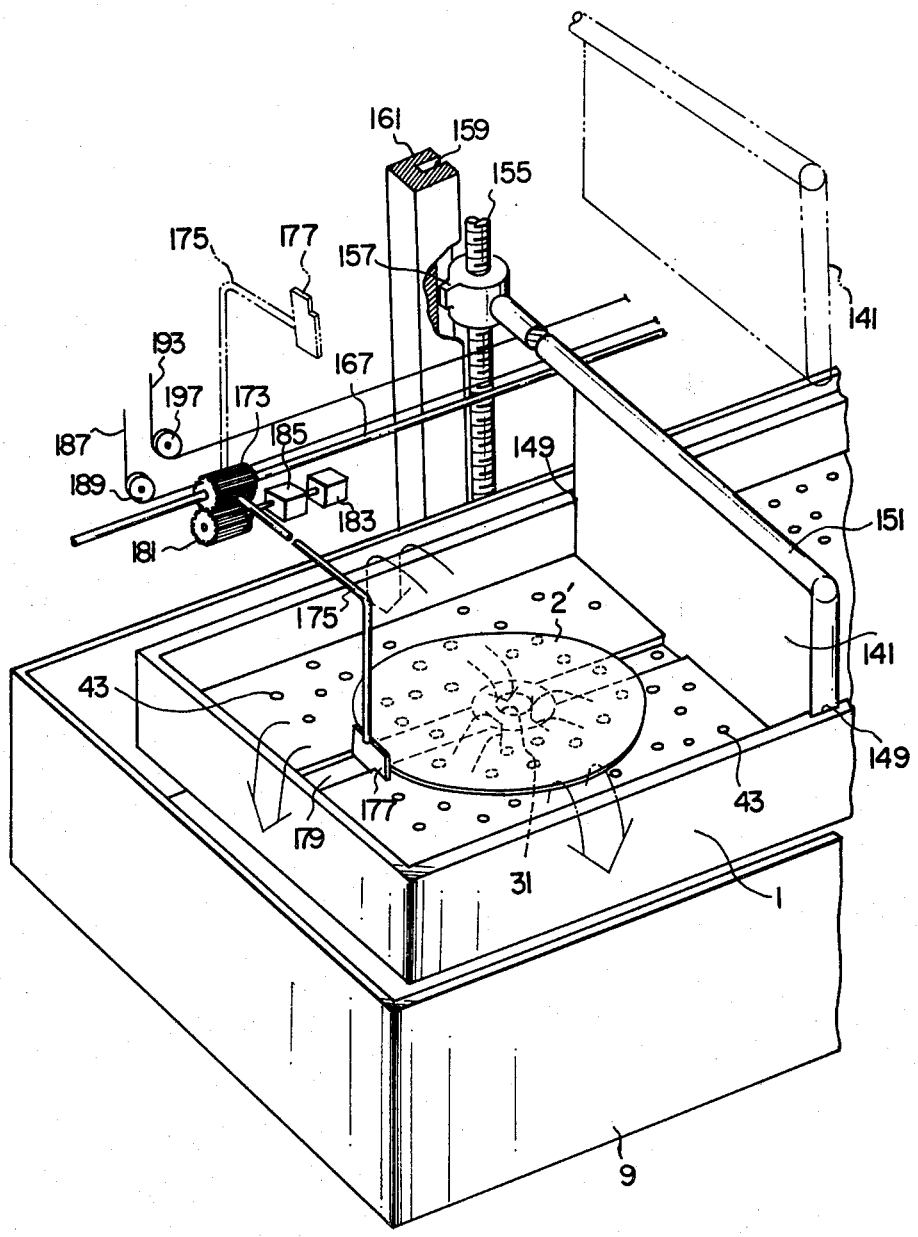
FIG. 3 is a perspective view showing the treatment bath shown in FIG. 2.

The treatment baths 1 and 3 and the intermediate bath 5 have a common bottom wall 23. Each of bottom wall sections 25, 27 and 29 of the respective baths 1, 5 and 3 has formed therein, as best shown in FIGS. 2 and 3, a central suction port 31, 33, 35 an annular distributing chamber 37, 39, 41 extending around the suction port, and a plurality of jet ports 43, 45, 47 provided in a top wall of the distributing chamber.

A tank 49 receiving therein a cleaning liquid of dillute hydrofluoric acid is associated with the treatment bath 1, and a tank 51 receiving therein a cleaning liquid of deionized water is associated with the treatment bath 3. A main line 53 has one end thereof connected to the tank 49 and the other end connected to a port 55 provided in the bottom wall section 25 of the treatment bath 1 so as to open to the distributing chamber 37. The main line 53 has provided therein a pump 57 for forcedly delivering the cleaning liquid from the tank 49 to the distributing chamber 37 through the main line 53, a filter disposed downstream of the pump 57 and having a mesh of above 0.2 μm for removing foreign matters each having a diameter of above 1 μm from the cleaning liquid passing through the line 53, a flow detector 61 disposed downstream of the filter for detecting the flow rate of the cleaning liquid passing through the main line 53 to generate a flow signal, and a control valve 63 disposed downstream of the detector 61 for controlling the flow rate of the cleaning liquid passing through the main line 53. A return line 65 has one end thereof connected to the central suction port 31 in the bottom wall section 25 of the treatment bath 1 and the other end connected to the tank 49. The return line 65 has provided therein a control valve 67 for controlling the flow rate of the cleaning liquid passing through the return line, and a flow detector 69 disposed downstream of the control valve 67 for detecting the flow rate of the cleaning liquid passing through the return line 65 to generate a flow signal. The signals from the flow detectors 61 and 69 are fed to a controller 71. A signal from the controller 71 in response to the signals from the flow detectors 61 and 69 is fed to an actuator 73 which is operative in response to the signal from the controller 71 to actuate the controll valves 63 and 67 so as to control the flow rate of the cleaning liquid discharged from the jet ports 43 and the flow rate of the cleaning liquid introduced into the suction port 31. As clearly indicated by arrows in FIG. 2, the cleaning liquid is jetted or injected from the jet ports 43 toward an undersurface of an article to be cleaned or semiconductor wafer 21 completely immersed in the cleaning liquid filled in the treatment bath 1. A portion of the cleaning liquid injected from the jet ports 43 flows into the central suction port 31 and the remaining portion is overflowed and received by the overflow bath 9. The flow of the cleaning liquid having the controlled flow rate from the jet ports 43 and the flow of the cleaning liquid having the controlled flow rate into the suction port 31 enable the wafer 21 to be stationarily suspended in the cleaning liquid. The cleaning liquid received by the overflow bath 9 is returned into the tank 49 through a drain line 76 which has one end thereof connected to a drain port 74 in the bottom of the overflow bath 9 and the other end connected to the return line 65 at a location downstream of the flow detector 69.

A branch line 77 has one end thereof connected to the main line 53 at a location downstream of the filter 59 and the other end connected to a port 79 in the bottom wall section 27 of the intermediate bath 5 so as to open to the distributing chamber 39. The branch line 77 has provided therein a control valve 81 disposed downstream of the filter 59, a flow detector 83 disposed downstream of the valve 81 for detecting the flow rate of the cleaning liquid passing through the branch line 77 to generate a flow signal, and a control valve 85 disposed downstream of the detector 83 for controlling the flow rate of the cleaning liquid passing through the branch line 77. A return line 87 has one end thereof connected to the central suction port 33 in the bottom wall section 27 of the intermediate bath 5 and the other end connected to a drain tank 89. The return line 87 has provided therein a control valve 91 for controlling the flow rate of the cleaning liquid passing through the return line 87, a flow detector 93 disposed downstream of the control valve 91 for detecting the flow rate passing through the return line 87 to generate a flow signal, and a control valve 88 disposed downstream of the detector 93. A branch line 90 has one end thereof connected to a portion of the return line 87 between the detector 93 and the valve 88 and the other end connected to the tank 49. A valve 92 is provided in the branch line 90. The signals from the detectors 83 and 93 are supplied to a controller 95. A signal from the controller 95 in response to the signals from the detectors 83 and 93 is supplied into an actuator 97 which is operative in response to the signal from the controller 95 to actuate the control valves 85 and 91 so as to control the flow rate of the cleaning liquid discharged from the jet ports 45 and the flow rate of the cleaning liquid introduced into the suction port 33. Thus, the semiconductor wafer completely immersed in the cleaning liquid filled in the intermediate bath 5 is maintained stationarily suspended in the cleaning liquid, similarly to the wafer 21 shown in FIG. 2. The cleaning liquid overflowed from the intermediate bath and received by the overflow bath 11 is returned to the return line 87 through a drain line 96 which has one end thereof connected to a drain port 94 in the bottom of the overflow bath 11 and the other end connected to the return line 87 at a location downstream of the flow detector 93.

A main line 99 has one end thereof connected to the tank 51 and the other end connected to a port 101 provided in the bottom wall section 29 of the treatment bath 3 so as to open to the distributing chamber 41. The main line 99 has provided therein a pump 103 for forcedly delivering the cleaning liquid from the tank 51 to the distributing chamber 41 through the main line 99, a filter 105 disposed downstream of the pump 103 and having a mesh of above 0.2 μm for removing foreign matters each having a diameter of above 1 μm from the cleaning liquid passing through the main line 99, a flow detector 107 disposed downstream of the filter 105 for detecting the flow rate of the cleaning liquid passing through the main line 99 to generate a flow signal, and a control valve 109 disposed downstream of the detector 107 for controlling the flow rate of the cleaning liquid passing through the main line 99. A return line 111 has one end thereof connected to the central suction port 35 in the bottom section 29 of the treatment bath 3 and the other end connected to the tank 51. The return line 111 has provided therein a control valve 113 for controlling the flow rate passing through the return line, and a flow detector disposed downstream of the control valve 113 for detecting the flow rate of the cleaning liquid passing through the return line 111. The signals from the flow detectors 107 and 115 is fed to a controller 117. A signal from the controller 117 in response to the signals from the flow detectors 107 and 115 is supplied to an actuator 119 which is operative in response to the signal from the controller 117 to actuate the control valves 109 and 113 so as to control the flow rate of the cleaning liquid discharged from the jet ports 47 and the flow rate of the cleaning liquid introduced into the suction port 35. Thus, the semiconductor wafer completely immersed in the cleaning liquid filled in the treatment bath 3 is maintained stationarily suspended in the cleaning liquid, similar to the wafer 21 shown in FIG. 2. The cleaning liquid overflowed from the treatment bath 3 and received by the overflow bath 13 is returned to the tank 51 through a drain line 120 which has one end thereof connected to a drain port 108 in the bottom of the overflow bath 13 and the other end connected to the return line 111 at a location downstream of the flow detector 115.

A branch line 121 has one end thereof connected to a portion of the main line between the filter 105 and the flow detector 107 and the other end connected to a portion of the branch line 77 between the flow control valve 81 and the flow detecter 83. A flow control valve 123 is provided in the branch line 121.

A supply line 125 has one end thereof connected to a portion of the main line 99 between the filter 105 and the flow detector 107 and the other end connected to an inlet port 127 in the wall of the drying bath 7. The supply line 125 is connected to a flow control valve 129. A drain line 131 has one end thereof connected to a drain port 133 in the wall of the drying bath 7 adjacent to the bottom thereof and the other end connected to the tank 51. The drain line 131 has provided therein a flow control valve 135. An overflow line 137 has one end thereof connected to an overflow port 139 in the upper portion of the peripheral wall of the drying bath 7 and the other end connected to the tank 51 so as to introduce the cleaning liquid overflowed from the drying bath into the tank 51.

The semiconductor wafer 21 is successively moved from the treatment bath 1 to the intermediate bath 5, and then from the intermediate bath to the treatment bath 3, while the semiconductor wafer 21 is maintained completely immersed in the cleaning liquid or liquids.

A device for moving the wafer 21 comprises three gates 141, 143 and 145. The gate 141 is disposed between the treatment bath 1 and the intermediate bath 5. The gate 141 is movable between a normally closed position, where the treatment bath 1 and the intermediate bath 5 are out of liquid communication with each other, and an open position where the treatment bath 1 filled with the cleaning liquid and the intermediate bath 5 filled with the same cleaning liquid are in liquid communication with each other. The gate 143 is disposed between the intermediate bath 5 and the treatment bath 3 similar to the gate 141, and the gate 145 is disposed between the treatment bath 3 and the drying bath 7 similar to the gate 141. Each of the gates 141, 143, 145 is sealingly engaged with a transverse groove 147 (FIGS. 1 and 2) and vertical grooves 149 (FIG. 3) formed between the adjacent two baths 1, 3, 5, 7, when the gate is in its closed position.

Each of the gates 141, 143, 145 is secured to a transverse rod 151 which has one end thereof secured to an internally threaded member 153. The threaded member 153 is threadedly engaged with a feed screw 155 and is moved therealong when the feed screw 155 is rotated, thereby to move the gate 141, 143, 145 between its closed and open positions. The internally threaded member 153 is provided with a projection 157 extending radially outwardly from the threaded member 153. The projection 157 is engaged with a guide groove 159 in a rail member 161 to prevent the threaded member 153 from being rotated together with the feed screw 155 when it is rotated. Each feed screw 155 is operatively connected to a reversible motor 163 through a reduction gear 165 so as to be driven by the motor.

The moving device includes a mechanism for moving the semiconductor wafer 21 between the adjacent two baths 1, 3, 5, 7. The moving mechanism comprises a guide rod 167 extending along the baths connected in series to each other. The guide rod 167 has opposite ends thereof secured to depending members 169 and 171, respectively. A cylindrical slider 173 having its toothed outer peripheral surface is mounted on the guide rod 167 so as to be movable therealong. An L-shaped arm 175 has one end thereof secured to the slider 173 and the other end secured to a carrier member or abutment member 177 which is slidingly engageable with a longitudinally continuous guide groove 179 formed in the bottom surfaces of the baths 1, 3 and 5. The arm 175 is movable between an operative position shown by the solid line in FIGS. 1–3 and an inoperative position shown by the phantom line in FIG. 3. A gear 181 operatively connected to a reversible motor 183 through a reduction gear 185 is engaged with the toothed outer peripheral surface of the slider 173 to angularly move the arm 175 between its operative and inoperative positions when the gear 181 is rotated. A cable 187 has one end thereof secured to one axial end face of the slider 173, extends around a sheave 189, and is wound around a drum 191. A cable 193 has one end thereof secured to the other axial end face of the slider 173, extends around a sheave 195 rotatably mounted on the depending member 171 and around a sheave 197, and is wound around a drum 199. The drum 191 is operatively connected to a reversible motor 21 through a gearing 201, a shaft 203, a gearing 205, a shaft 207 and a gearing 209. The drum 199 is operatively connected to the reversible motor 211 through a gearing 213, a shaft 215, a gearing 217, a shaft 219 and the gearing 209. When the reversible motor 211 is operated, the gearing 209 rotates the shafts 207 and 219 in the directions opposite to each other to rotate drums 191 and 199 in the directions opposite to each other. As the reversible motor 211 is rotated in one direction, the slider 173 connected to the cables 187 and 193 is moved in one direction along the guide rod 167, and as the reversible motor 211 is rotated in the opposite direction, the slider 173 is moved in the opposite direction along the guide rod 167.

Figure 4:
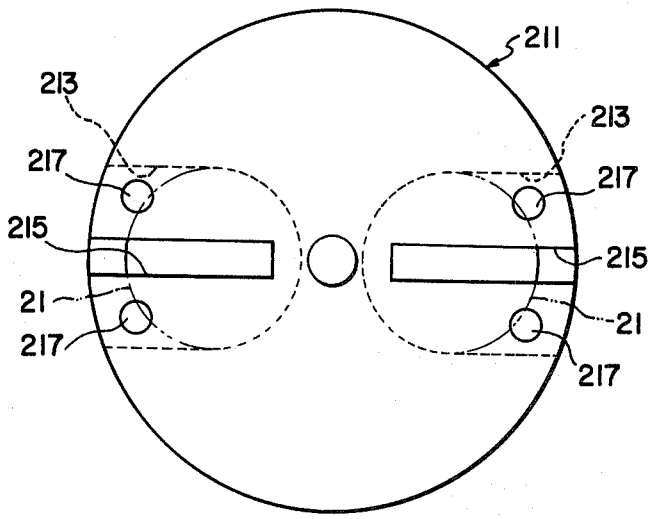
FIG. 4 is a top plan view of a centrifugal dryer shown in FIG. 1.

A centrifugal dryer associated with the drying bath 7 includes a rotatable disc 211 which is movable between a first position shown by the solid line in FIG. 1 and located inside of the drying bath 7 and a second position shown by the phantom line in FIG. 1 and located outside of the drying bath. The rotatable disc 211 has formed therein a pair of diametrically opposed recesses 213 for receiving and holding the semiconductor wafers 21, respectively and radial slots 215 provided in the top walls of the recesses 213 in communication therewith, respectively. A pair of removable pins 217 associated with each of the recesses 213 are removed when the wafer 21 shown by the phantom line in FIG. 4 is inserted into the recess 213 and are located in position after the wafer 21 is inserted into the recess. The rotatable disc 211 is mounted on one end of a shaft 217 for rotation therewith, and the other racked end portion 219 of the shaft 217 is operatively connected to a reversible motor 221 through a gearing 223. The gearing 223 is of any type known to one skilled in the art in which the gearing 223 allows the shaft to be rotated when the disc 211 is in the position shown by the solid line in FIG. 1, and also allows the shaft 217 to be moved between the position shown by the solid line in FIG. 1 and the position shown by the phantom line in FIG. 1 while the shaft 217 is maintained so as not to be rotated.

As the disc 211 is moved to the position shown by the phantom line in FIG. 1, the slot 215 in the disc 211 is aligned with a vacuum carrier 225. The vacuum carrier 225 has a hollow body 227 having a rectangular cross-section. The hollow body 227 has one end portion thereof in which a plurality of suction ports 229 are formed in a bottom wall of the hollow body and communicate with a hollow portion 231 of the hollow body, and the other end portion in which a rack is formed in an outer surface of the bottom wall of the hollow body 227. The hollow portion 231 is communicated with a vacuum pump 235 through a flexible tube 237 and a three-way valve 239 provided therein. A pinion 241 engaging with the rack 233 is operatively connected to a reversible motor 243 through a reduction gear 245. As the pinion 241 is rotated in one and opposite directions in accordance with the rotating directions of the reversible motor 243, the hollow body 227 is reciprocated.

In operation, the gates 141, 143 and 145 are in their closed positions, and the arm 177 is moved in the inoperative position shown by the phantom line in FIG. 3. The flow control valve 81 is fully opened. The pump 57 is operated to forcedly deliver the cleaning liquid from the tank 49 to the treatment bath 1 and the intermediate bath 5 through the main line 53 and the branch line 77, thereby to fill the treatment and intermediate baths 1 and 5 with the cleaning liquid from the tank 49.

The flow control valve 123 provided in the branch line 121 is fully closed. The flow control valve 129 provided in the main line 125 is opened and the flow control valve 135 provided in the return line 131 is closed. The pump 103 is operated to forcedly deliver the cleaning liquid from the tank 51 to the treatment bath 3 and the drying bath 7 through the main lines 99 and 125, thereby to fill the treatment bath 3 and the drying bath 7 with the cleaning liquid from the tank 51. At this time, the disc 211 is located in the position shown by the solid line in FIG. 1.

The semiconductor wafers 21 to be cleaned are delivered by a conveyor 247 and are introduced one by one into the treatment bath 1 filled with the cleaning liquid. The wafer 21 is completely immersed in the cleaning liquid filled in the treatment bath 1 and is maintained stationarily suspended in the cleaning liquid, as described previously. The wafer 21 is cleaned by the cleaning liquid filled in the treatment bath 1 so that foreign matters are removed from the surface of the wafer 21. At this time, the arm 175 is moved to its operative position shown by the solid line in FIGS. 2 and 3.

After the wafer 21 is cleaned by the cleaning liquid within the treatment bath 1, the gate 141 is moved from its closed position to its open position shown by the phantom line in FIG. 3 to allow the treatment bath 1 and the intermediate bath 5 to be in liquid communication with each other. Then, the slider 173 is moved along the guide rod 167, and the carrier or abutment member 177 secured to the arm 175 abuts against the peripheral edge of the wafer 21 to move the wafer into the intermediate bath 5 while the wafer is maintained completely immersed in the cleaning liquid.

After the wafer 21 is moved into the intermediate bath 5, the abutment member 177 is maintained in the position within the intermediate bath 4, and the gate 141 is moved to its closed position. A subsequent one of the wafers 21 to be cleaned is immersed in the cleaning liquid filled in the treatment bath 1. After the movement of the wafer 21 into the intermediate bath 5, the flow control valve 81 in the branch line 77 is closed, and the flow control valve 123 in the branch line 121 is opened. In addition, the flow control valve 88 in the return line 87 is opened. The cleaning liquid within the tank 51 is forcedly delivered by the pump 103 into the intermediate bath 5 through the main line 99 and the branch line 121. Thus, the cleaning liquid from the tank 49 filled in the intermediate bath 5 is gradually replaced with the cleaning liquid from the tank 51, and is finally completely replaced with the cleaning liquid from the tank 51. During the replacement of the cleaning liquids, the wafer 21 is completely immersed in at least one of the cleaning liquid from the tank 49 and the cleaning liquid from the tank 51 and is suspended in the cleaning liquid or liquids within the intermediate bath 5.

As the intermediate bath 5 is filled with the cleaning liquid from the tank 51, the gate 143 is moved from its closed position to its open position to allow the intermediate bath 5 and the treatment bath 3 to be in liquid communication with each other. Then, the slider 173 is further moved along the guide rod 167, and the carrier member 177 moves the wafer 21 from the intermediate bath 5 into the treatment bath 3, while maintaining the wafer completely immersed in the cleaning liquid.

After the wafer 21 is moved into the treatment bath 3, the abutment member 177 is held in the position within the treatment bath 3, and the gate 143 is moved from its open position to its closed position. The wafer 21 is cleaned by the cleaning liquid within the treatment bath 3, while the wafer is maintained completely immersed in the cleaning liquid, so that foreign matters are removed from the surface of the wafer 21.

After the wafer 21 is cleaned by the cleaning liquid within the treatment bath 3, the gate 143 is moved from its closed position to its open position to allow the treatment bath 3 and the drying bath 7 to be in liquid communication with each other. Then, the slider 173 is further moved along the guide rod 167, and the carrier member 177 inserts the wafer 21 into one of the recesses 213 in the disc 211 with the pins 217 removed. The other resess 213 has received therein the wafer treated by the previous cleaning operation. After the wafer is received in the one recess 213, the gate 143 is moved from its open position to its closed position, and the pins 217 are located in their positions. Then, the flow control valve 129 is closed and the flow control valve 13 is opened to substantially completely drain the cleaning liquid from the drying bath 7 to expose the disc 211 having wafers 21 received and held in the pair of recesses 213, respectively. Then, the disc 211 is rotated to dry the wafers 21 held therein. Then, the disc 211 is moved to the position shown by the phantom line in FIG. 1 to cause the upper surface of the wafer 21 to abut against the bottom surface of the hollow body 227 of the vacuum carrier 225. The vacuum pump 235 is operated to cause the dryed wafer to be attracted against the outer surface of the bottom wall of the hollow body 227. Then, the pins 217 are removed. The carrier 225 moves the dryed wafer 21 out of the recess 213 in the disc 211 with the wafer attracted against the hollow body 227.

The arm 175 located within the drying bath 7 is angularly moved to a position similar to the position shown by the phantom line in FIG. 3 by a not shown mechanism similar to that 181, 183 and 185. The slider 173 is moved along the guide rod 167 toward the treatment bath 1 and is returned to the original position shown in FIG. 3. The slider 173 is then angularly moved by the gear 181 to move the arm 175 from the position shown by the phantom line in FIG. 3 to the position shown by the solid line therein.

As described above, the wafer 21 is maintained completely immersed in the cleaning liquid throughout the entire operating steps from the time that the wafer is introduced into the treatment bath 1 to the time that the cleaning operation is completed. This causes the number of foreign matters deposited on the wafer 21 to be minimized. In addition, since wafers are treated one by one, i.e., are subjected to an individual wafer cleaning process, there is provided an even or uniform cleaning efficiency with respect to each wafer. Moreover, such individual wafer cleaning process makes it unnecessary to use a jig, such as holder or cartiridge for holding a plurality of wafers during the cleaning of the wafers, and the chipping of the peripheral edge of the wafer, which occurs when the wafers are mounted on and removed from the jig, can be avoided. In addition, due to the individual wafer cleaning process, the continuous treatment of the wafers is facilitated, and the treatment baths can be small-sized. This enables the quantity of the cleaning liquid used to be reduced.

Furthermore, in addition to the individual wafer cleaning process, since the wafer is maintained stationary in the cleaning liquid within each bath without use of any jig, the contact between the wafer surface and another solid body is minimized and the number of foreign matters transferred from the solid body to the wafer is minimized.

In the embodiment described above, because the wafer is moved under such condition that the wafer is completely immersed in the cleaning liquid, not only during the cleaning operation, but also during the movement of the wafer from the last treatment bath into the drying bath, the deposition of the foreign matters on the wafer is further minimized.

Figure 5:
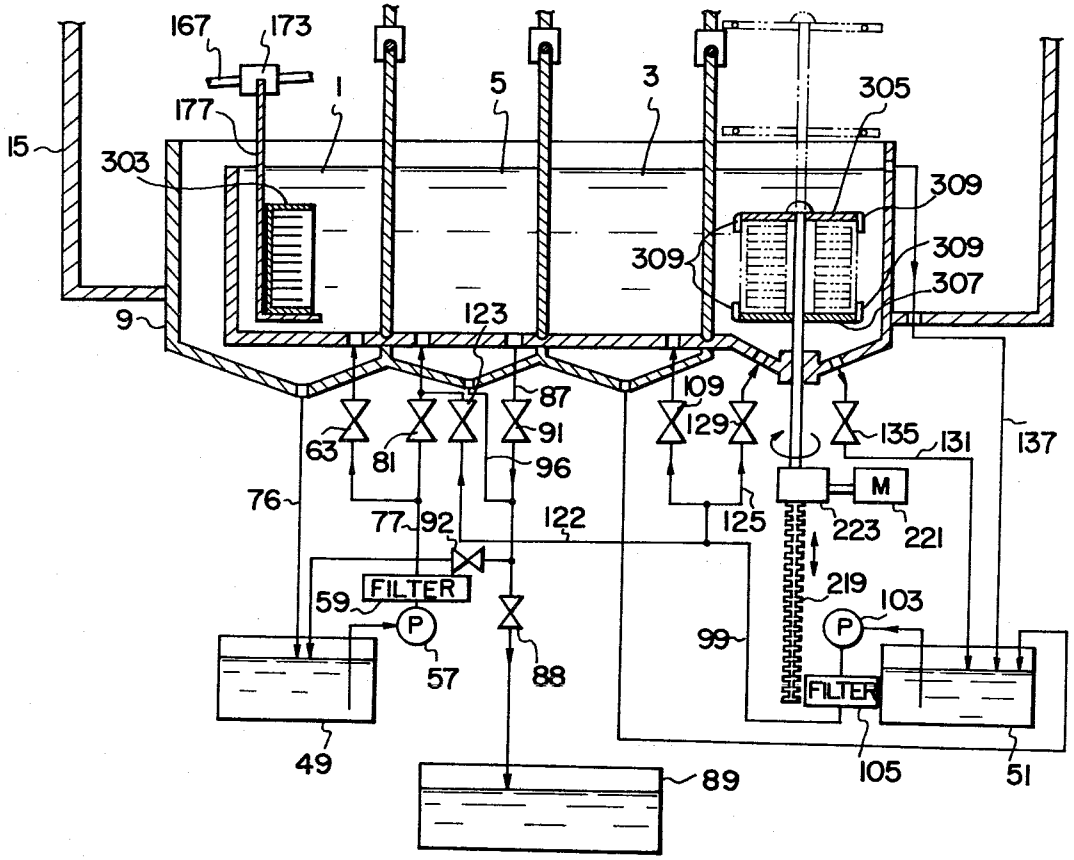
FIG. 5 is a schematic cross-sectional view showing another embodiment of an article cleaning system in accordance with the present invention.
Figure 6:
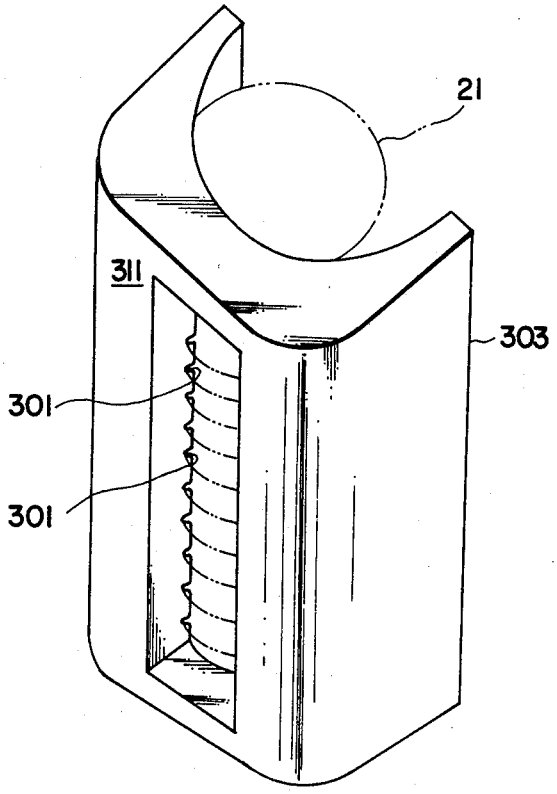
FIG. 6 is a perspective view showing a cartridge shown in FIG. 5, the cartridge receiving and holding therein a plurality of articles to be cleaned.

FIGS. 5 and 6 illustrate another embodiment of the cleaning system in accordance with the present invention. In the cleaning system show in FIGS. 5 and 6, the same reference characters are applied to parts and members which have their functions similar or common to those of the parts and members used in the embodiment described with reference to FIGS. 1–4, and the description on such parts and members will be omitted for simplification.

In the cleaning system illustrated in FIGS. 5 and 6, a plurality of wafers 21 (ten in number in the illustrated embodiment) are received and held respectively in arcuate grooves 301 provided in a cartridge 303 shown in detail in FIG. 6. The cartridge 303 holding therein the wafers 21 is moved between the baths in the same manner as that described with reference to FIGS. 1–4, while the wafers 21 are maintained continuously and completely immersed in the cleaning liquid. Accordingly, the detailed description will be omitted, but the operation of the cleaning system shown in FIGS. 5 and 6 will be obvious to one skilled in the art from the above description with reference to FIGS. 1–4.

A centrifugal dryer includes an upper flange 305 and a lower flange 307 spaced therefrom downwardly. Each flange has locking members 309 mounted on the peripheral edge of the flange. When the cartridge 303 is moved into the drying bath 7 and is received between the upper and lower flanges 305 and 307, the locking members 309 are engaged with a rear surface 311 (FIG. 6) to prevent the cartiridge 303 from being out of between the flanges.

In the cleaning system shown in FIGS. 5 and 6, since it is unnecessary to maintain the wafers 21 stationarily suspended in the cleaning liquid, the cleaning system has no flow detectors, controllers and actuators of the system illustrated in FIGS. 1–4.

Also in the cleaning system shown in FIGS. 5 and 6, because the wafers 21 are moved between the baths while they are maintained continuously and completely immersed in the cleaning liquid, the number of the foreign matters deposited on the wafers is considerably reduced. In addition, since a great number of wafers are treated at a time, the cleaning efficiency is increased.

Experiments have been conducted to compare the number of the foreign matters having their diameter of above 1 μm on the main surface of the wafer dryed in case where the wafer having its diameter of 76 mm is moved between a plurality of treatment baths and a drying bath within the atmosphere (within a clean room of Class 1000), with the number of the foreign matters having their diameter of above 1 μm on the main surface of the wafer having its diameter of 76 mm treated in accordance with the cleaning system according to the embodiment of the present invention shown in FIGS. 1–4. The results of the experiments have indicated that the number of the foreign matters on the wafer main surface treated in accordance with the embodiment of the present invention is reduced to a level of 1/10. More particularly, in case of the former treatment, the number of the foreign matters having their diameter of above 1 μm was approximately 200–1000 per unit wafer. The number of the foreign matters having their diameter of above 1 μm on the wafer main surface treated in accordance with the embodiment of the present invention was several to several tens.

With reference to FIGS. 1–4, although the cleaning liquid has been described as being continuously overflowed from each bath, an article to be cleaned may be starionarily suspended in the cleaning liquid without overflowing of the cleaning liquid, dependent upon configuration and size of the article to be cleaned.

What we claim is:

1. A system for cleaning articles to remove foreign matters from surfaces of the articles, comprising:

at least two treatment baths and an intermediate bath disposed between the adjacent two treatment baths, these baths being connected in series to each other, at least one of said articles to be cleaned being successively moved from a first to the last one of said treatment baths through at least one said intermediate bath;

tanks with one associated with each of said treatment baths and receiving respective cleaning liquids;

supply line means for connecting each of said at least two treatment baths and the adjacent intermediate bath to the tank associated with the treatment bath;

delivery means for forcedly delivering the cleaning liquid from each of said tanks to the associated treatment bath and the adjacent intermediate bath through the associated supply line means;

when a first of said at least two treatment baths is filled with a first of the cleaning liquids supplied from a first of said tanks associated with said first treatment bath through a frist of said supply line means associated with said first treatment bath by a first of said delivery means associated with said first treatment bath, said article being completely immersed in said first cleaning liquid within said first treatment bath and cleaned by said first cleaning liquid so as to cause foreign matters to be removed from the surface of said article;

moving means for moving said article between each of said at least two treatment baths and the adjacent intermediate bath, said moving means moving said article from said first treatment bath filled with said first cleaning liquid to said intermediate bath filled with said first cleaning liquid supplied from said first tank through said first supply line means by said first delivery means, while maintaining said article completely immersed in said first cleaning liquid, said article being completely immersed in said first cleaning liquid within said intermediate bath;

replacing means for replacing said first cleaning liquid within said intermediate bath with a second of the cleaning liquids supplied from a second of said tanks associated with a second of said at least two treatment baths adjacent to said first treatment bath through a second of said supply line means associated with said second treatment bath by a second of said delivery means associated with said second treatment bath, after said article is moved from said first treatment bath filled with said first cleaning liquid to said intermediate bath filled with said frist cleaning liquid by said moving means; and after said first cleaning liquid within said intermediate bath is replaced with said second cleaning liquid, said moving means moving said article from said intermediate bath filled with said second liquid to said second treatment bath filled with said second cleaning liquid supplied from said second tank through said second supply line means by said second delivery means, while maintaining said article completely immersed in said second cleaning liquid, said article being completely immersed in said second cleaning liquid within said second treatment bath and being cleaned by said second cleaning liquid so as to cause foreign matters to be removed from the surface of said article.

2. A cleaning system defined in claim 1, wherein said replacing means replace said second cleaning liquid within said intermediate bath with said first cleaning liquid supplied from said first tank through said first supply line means by said first delivery means, after said article is moved from said intermediate bath filled with said second cleaning liquid to said second treatment bath filled with said second cleaning liquid by said moving means, to prepare for the movement of a subsequent one of said articles to be cleaned from said first treatment bath into said intermediate bath.

3. A cleaning system defined in claim 2, wherein said moving means comprises:

a carrier member engageable with said article immersed in the cleaning liquid filled in each of said at least two treatment baths and the adjacent intermediate bath;

a first moving mechanism for moving said carrier member along said baths connected in series to each other;

a gate disposed between each of said at least two treatment baths and the adjacent intermediate bath;

a second moving mechanism for moving said gate between a normally closed position where said treatment bath and said intermediate bath are out of liquid communication with each other and an open position where said treatment bath and said intermediate bath are in liquid communication with each other;

when said gate is moved from said closed position to said open position by said second moving mechanism, said first moving mechanism causing said carrier member to move said article between said treatment bath filled with the cleaning liquid and said intermediate bath filled with the cleaning liquid the same as the filled in said treatment bath, while maintaining said article completely immersed in the cleaning liquid; and when said gate is moved from said open position to said closed position by said second moving mechanism, said replacing means replacing the cleaning liquid within said intermediate bath with another cleaning liquid.

4. A cleaning system defined in claim 3, further comprising:

suspending means for maintaining said article suspended in the cleaning liquid during the cleaning of said article by said cleaning liquid within each of said at least two treatment baths and during the replacement of the cleaning liquid within the adjacent intermediate bath.

5. A cleaning system defined in claim 4, wherein said articles are immersed one by one in the cleaning liquid in each of said treatment and intermediate baths and are moved one by one between said baths.

6. A cleaning system defined in claim 5, wherein said suspending means comprises:

a plurality of jet ports provided in a bottom wall of each of said treatment and intermediate baths, said plurality of jet ports being connected to the associated supply line means for jetting a flow of the cleaning liquid toward an undersurface of the article immersed in the associated bath; and at least one suction port provided in the bottom wall of said treatment and intermediate baths of sucking the cleaning liquid within the bath.

7. A cleaning system defined in claim 6, further comprising:

a first return line connecting the tank associated with each of said treatment baths to said suction port in the bottom wall of the treatment bath associated with said tank;

a second return line connected to said suction port in the bottom wall of said intermediate bath adjacent to said treatment bath;

a first valve provided in the supply line means associated with said treatment bath for controlling the flow of the cleaning liquid passing through said supply line means;

a second valve provided in said first return line for controlling the flow of the cleaning liquid passing therethrough;

a third valve provided in said second return line for controlling the flow of the cleaning liquid passing therethrough; and control means for controlling said first, second and third valves so as to respectively maintain said article suspended in the cleaning liquid within said treatment bath and said article suspended in the cleaning liquid within the adjacent intermediate bath

8. A cleaning system defined in claim 7, wherein each of said supply line means includes a main line connecting the associated tank and said jet ports in the bottom wall of the associated treatment bath to each other, and a branch line having one end thereof connected to said main line and the other end communicating with said jet ports in the bottom wall of the adjacent intermediate bath; and wherein said replacing means includes a fourth valve provided in said branch line of said supply line means associated with each of said treatment baths, and a fifth valve provided in said branch line of said supply line means associated with the intermediate bath adjacent to said treatment bath, said fourth valve being open and closed when said fifth valve is closed and opened, respectively.

9. A cleaning system defined in claim 8, further comprising:

a drying bath disposed adjacent to the last one of said at least two treatment baths;

a centrifugal dryer rotatably disposed within said drying bath;

means for rotating said centrifugal dryer;

a third main line having one end thereof connected to said supply line means associated with said last treatment bath and the other end connected to said drying bath;

a sixth valve provided in said third main line;

a drain line connected to said last treatment bath;

a seventh valve provided in said drain line;

said moving means furrther including a last gate disposed between said last treatment bath and said drying bath, said last gate being movable by said second moving mechanism between a normally closed position where said last treatment bath and said drying bath are out of liquid communication with each other and an open position where said last treatment bath and said drying bath are in liquid communication with each other;

when said last gate is moved from its closed position to its open position by said second moving mechanism to allow said last treatment bath filled with the cleaning liquid supplied from said tank associated with said last treatment bath through the associated supply line means by the associated delivery means and said drying bath filled with the cleaning liquid supplied from said tank associated with said last treatment bath through the associated supply line means and said third main line by the associated delivery means to be in liquid communication with each other with said sixth valve opened and said seventh valve closed, said first moving mechanism of said moving means causing said carrier member to move said article from said last treatment bath to said drying bath, while maintaining said article completely immersed in the cleaning liquid, so that said article is received and held in said dryer;

said sixth valve being closed and said seventh valve being opened when said article is received and held in said dryer, to allow the cleaning liquid to be drained from said drying bath to expose said dryer having received and held therein said article; and when said dryer is exposed, said rotating means rotating said dryer to dry said article received and held therein.

10. A cleaning system defined in claim 3, further comprising:

a cartridge receiving therein a plurality of said articles; and said moving means moving said cartridge between each of said treatment baths and the adjacent intermediate bath.

11. A cleaning system defined in claim 10, further comprising:

a drying bath disposed adjacent to the last one of said at least two treatment baths;

a centrifugal dryer rotatably disposed within said drying bath;

means for rotating said centrifugal dryer;

fixing means for fixing said cartridge to said centrufugal dryer;

a main line having one end thereof connected to said supply line means associated with said last treatment bath and the other end connected to said drying bath;

a first valve provided in said main line;

a drain line connected to said last treatment bath;

a second valve provided in said drain line;

said moving means further including a last gate disposed between said last treatment bath and said drying bath, said last gate being movable by said second moving mechanism between a normally closed position where said last treatment bath and said drying bath are out of liquid communication with each other and an open position where said last treatment bath and said drying bath are in liquid communication with each other;

when said last gate is moved from its closed position to its open position by said second moving mechanism to allow said last treatment bath filled with the cleaning liquid supplied from said tank associated with said last treatment bath through the associated supply line means by the associated delivery means and said drying bath filled with the cleaning liquid supplied from said tank associated with said last treatment bath through the associated supply line means and said main line by the associated delivery means to be in liquid communication with each other with said first valve opened and said second valve closed, said first moving mechanism of said moving means causing said carrier member to move said cartridge having received and held therein said articles from said last treatment bath to said drying bath, while maintaining said articles received and held in said cartridge completely immersed in the cleaning liquid, so as to fix said cartridge to said dryer by said fixing means;

said first valve being closed and said second valve being opened when said cartridge is fixed to said dryer, to allow the cleaning liquid to be drained from said drying bath to expose said dryer having fixed thereto said cartridge; and when said dryer is exposed, said rotating means rotating said dryer to dry said articles received and held in said cartridge fixed to said dryer.

12. A cleaning system defined in claim 2 or 10, wherein the cleaning liquid is supplied into each of said at least two treatment baths and the adjacent intermediate bath from said tank associated with said treatment bath through the associated supply line means by associated delivery means so that the cleaning liquid is maintained continuously overflowed from said baths.

13. A cleaning system defined in claim 12, wherein each of said articles has a water-repellent surface.

14. A cleaning system defined in claim 13, wherein each of said articles is in the form of lamina.

15. A cleaning system defined in claim 14, wherein each of said article is a semiconductor wafer.

16. A cleaning system defined in claim 15, wherein said first cleaning liquid is a dillute hydrofluoric acid, and said second cleaning liquid is a deionized water.

* * * * *